US005263349A

United States Patent [19]

Felix et al.

[11] Patent Number: 5,263,349

[45] Date of Patent: Nov. 23, 1993

[54] EXTRUSION OF SEAMLESS MOLYBDENUM RHENIUM ALLOY PIPES

[75] Inventors: Vinci M. Felix, Kennett Square, Pa.; David A. Wells, Newark, Del.

[73] Assignee: E. I. Du Pont de Nemours and Company, Wilmington, Del.

[21] Appl. No.: 949,201

[22] Filed: Sep. 22, 1992

[51] Int. Cl.[5] ..... B21D 37/16

[52] U.S. Cl. ..... 72/38; 72/364; 72/257

[58] Field of Search ..... 72/38, 364, 264, 265, 72/266, 267, 257; 148/668

[56] References Cited

U.S. PATENT DOCUMENTS

| | | | |
|---|---|---|---|
| 2,666,721 | 1/1954 | Bechtold et al. | 148/668 |
| 2,721,138 | 10/1955 | Baker et al. | 148/668 |
| 3,173,283 | 3/1965 | Vogtmann | 72/364 |
| 3,350,907 | 11/1967 | McDonald et al. | 72/38 |
| 3,570,106 | 3/1971 | McGurty et al. | 29/423 |
| 3,796,082 | 3/1974 | Honsinger et al. | 72/256 |
| 3,804,045 | 4/1974 | Banks, Jr. | 148/668 |
| 3,987,655 | 10/1976 | Myotte | 72/60 |
| 4,077,811 | 3/1978 | Burman | 72/364 |

FOREIGN PATENT DOCUMENTS

| | | | |
|---|---|---|---|
| 0701817 | 1/1965 | Canada | 72/257 |

OTHER PUBLICATIONS

"Theoretical and Experimental Study of the Glass Lubricated Extrusion Process", Jan. 1975, P. Baque, J. Pantin and G. Jacob.

"Effect of Deformation Conditions on the Quality of Molybdenum Tubes", Kravchenko et al., 1991.

"Production of Pipes From M-lybdenum by Extrusion and Rolling in an Oblique Rolling Mill", Kozeradskii et al., 1982.

"Extrusion and Rolling of Tube Billets from High--Melting Metals", Krupin et al, 1979.

"Preparation and Properties of Long Molybdenum Tubes", J. Devillard 1978.

"Study of Processes for the Plastic Forming of Pipe Blanks from Factory Metals", Polukhin et al. 1977.

"An Initial Evaluation of Molybdenum-Rhenium Alloy for Reactor Heat Pipes", Merrigan et al., 1983.

"Critical Evaluation of Molybdenum and its Alloys for use in Space Reactor Core Heat Pipes", L. B. Lundberg, 1981.

"Effect of Heat Treatment on Structure and Properties of Alloys Based on Refractory Metals", Yu. V. Mil'man. 1984.

*Primary Examiner*—Lowell A. Larson
*Assistant Examiner*—Michael J. McKeon
*Attorney, Agent, or Firm*—Michael K. Boyer

[57] ABSTRACT

The present invention relates to a process for extruding molybdenum-rhenium alloys into tubes or pipes. The invention is capable of high temperature extrusion of MoRe alloys, which comprise about 10 to 50 wt. % rhenium, into a seamless piper or tube. The steps of the process generally comprise fabricating a MoRe billet or blank which includes a pilot hole that extends along the longitudinal axis of the billet, heating the billet to a temperature of at least about 1300° C., and extruding the heated billet by operation of an extrusion press.

10 Claims, 3 Drawing Sheets

EXTRUSION OF SEAMLESS MOLYBDENUM RHENIUM ALLOY PIPES

FIELD OF THE INVENTION

The present invention relates to the field of extruding molybdenum rods, tubes and pipes.

BACKGROUND OF THE INVENTION

Molybdenum (Mo) metal is used for various specialty applications which require its unusual properties. The melting point of molybdenum is 2630° C., which is over 1000° C. higher than iron, thereby permitting molybdenum to be used for furnace components, rocket nozzles and in other high-temperature applications where most metals would melt or fail. Molybdenum also possesses resistance to corrosion by mineral acids when exposed to such acids under nonoxidizing conditions.

However, the high melting point and poor ductility of molybdenum requires that special manufacturing techniques be employed when producing molybdenum metal and articles therefrom. Molybdenum is usually manufactured as a powder. The molybdenum powder may be compacted into a bar by using conventional powder-metallurgy techniques, and the resulting bar then sintered and densified by electric currents or in a hydrogen-atmosphere muffle furnace. The use of hydrogen is required to eliminate any oxygen because even trace amounts of oxygen in molybdenum will adversely effect the ductility of molybdenum. In some molybdenum production processes, an ingot of molybdenum is obtained by arc-casting using consumable electrode melting under a vacuum.

The mechanical properties of an article fabricated from molybdenum are acceptable so long as the metal is shaped or worked below its recrystallization temperature, thus avoiding recrystallization and grain growth. When recrystallization has occurred, molybdenum has a tendency to become brittle at relatively low temperatures, e.g., near room temperature and below. Recrystallization becomes difficult to avoid when the process for manufacturing a molybdenum article requires that the metal be worked at high temperatures, e.g., brazing or welding can cause recrystallization because high temperatures exist locally at the brazing or welding site. The tendency of recrystallized molybdenum to become brittle is a deterrent to using molybdenum in many applications.

SUMMARY OF THE INVENTION

The present invention relates to a process for extruding molybdenum-rhenium (hereinafter referred to "MoRe") alloys into tubes or pipes. The invention is capable of high temperature extrusion of MoRe alloys, which comprise about 10 to 50 wt. % rhenium, into a seamless pipe or tube. The steps of the process generally comprise fabricating a MoRe billet or blank which includes a pilot hole that extends along the longitudinal axis of the billet, heating the billet to a temperature of at least about 1300° C., and extruding the heated billet by operation of an extrusion press, which is equipped with a mandrel for applying an adequate press force.

The MoRe billet can be produced by any acceptable technique such as a powder metallurgy technique. Before extruding the billet, the billet is heated to a first temperature of about 1100 degrees C. within a furnace under a protective gas atmosphere which comprises inert gases such as $CO_2$, $N_2$, among others. The protective atmosphere can further comprise a reducing gas such as $H_2$, CO, among others. The billet is heated further to a second temperature of at least about 1300 degrees C. by employing electrical induction heating, and then extruded.

It was discovered that the forming resistance of a MoRe alloy was greater than that for molybdenum. As the hot forming resistance of a material increases, so does the necessary extrusion force and difficulty of extrusion. For example, Mo41%Re alloy has a hot forming resistance of about 690 to about 700 N/sq. mm (about 100,100 to about 101,500 psi), at 1280° C., thereby rendering Mo41%Re about 48% more difficult to extrude than molybdenum. Accordingly, it was a surprising and unexpected result that the claimed invention is capable of extruding a MoRe alloy into a seamless pipe or tube.

By providing a process for extruding a MoRe alloy, the present invention overcomes the disadvantages of conventional practices. Conventional practices were unable to extrude MoRe alloys into pipes or tubes, and relied upon drilling, acid etching, among other complex methods, in order to obtain even marginally useful articles. The present invention fills the need for a method which is capable of extruding MoRe alloy pipes and tubes without the need for such complex conventional practices.

BRIEF DESCRIPTION OF THE DRAWINGS

FIG. 2 illustrates the inter-relationship among the heating means, and the extruder.

DETAILED DESCRIPTION OF THE INVENTION

Figure 1:
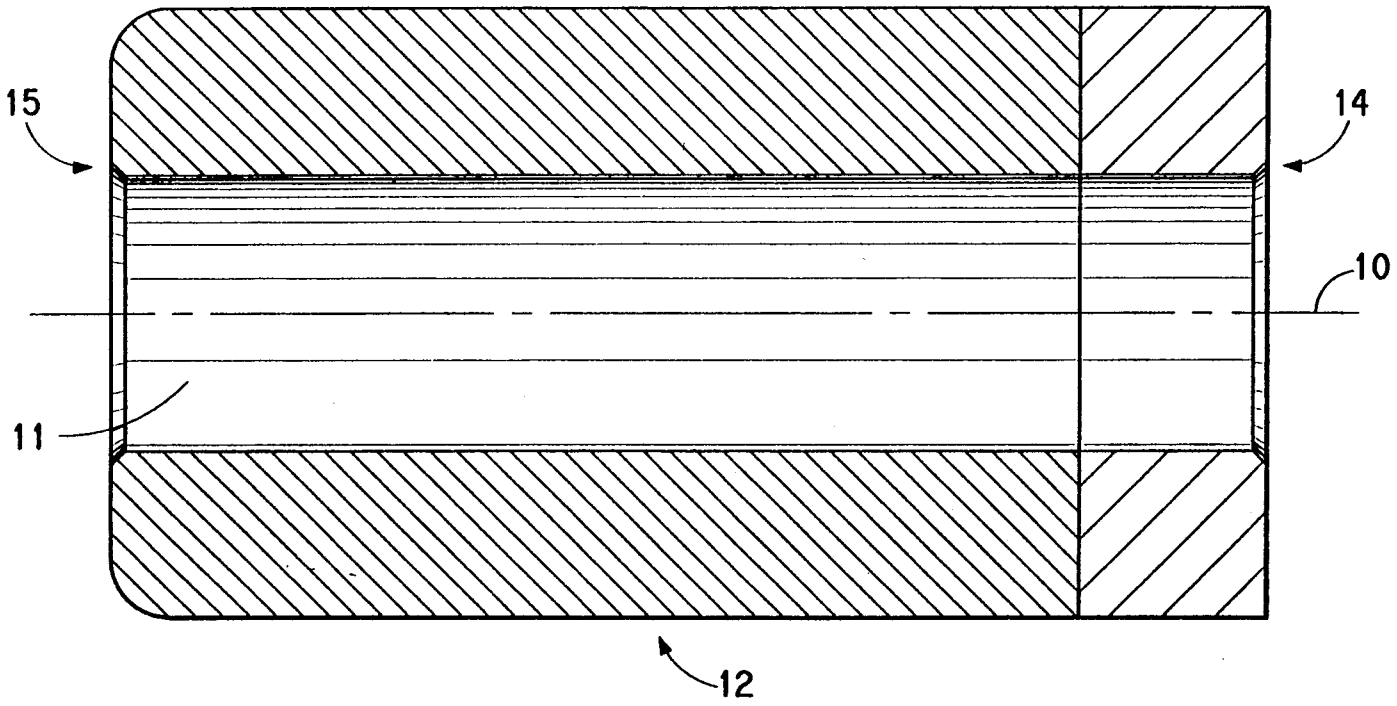
FIG. 1 is a cross-sectional drawing of a billet which can be extruded into a seamless pipe or tube. The relative dimensions that are illustrated in this drawing are to scale.

The present invention fills the need for a manufacturing process which is capable of extruding molybdenum alloy tubes, or pipes. Such pipes and tubes can be used to fabricate equipment which is employed for manufacturing alternative fluorocarbon compounds. The alternative fluorocarbons, known as hydrochlorofluorocarbons (HCFCs), and hydrofluorocarbons (HFCs), have a relatively low and zero ozone depleting potential, respectively, than conventional chlorofluorocarbons (CFCs). Suitable techniques for manufacturing the alternative HCFCs and HFCs are disclosed in U.S. Pat. Nos. 4,258,225, and 4,967,024, which are hereby incorporated by reference. Such manufacturing techniques require using hydrogen fluoride in combination with highly acidic, corrosive and erosive catalysts, such as tantalum pentafluoride ($TaF_5$), niobium pentafluoride ($NbF_5$), among others. These manufacturing techniques create an environment which is extremely acidic that corrodes conventional manufacturing equipment. The by-products of the corrosion process are released into the manufacturing process, thereby contaminating the resultant fluorocarbon, poisoning the perfluorinated catalyst, and causing undesired side-reactions. The present invention provides a method for extruding continuous lengths of corrosion resistant molybdenum alloy pipes, tubes, among others, which can be fabricated into equipment that ameliorates, if not eliminates, the contamination associated with conventional manufacturing equipment. For example, equipment which has been fabricated from an extruded MoRe pipe or tube would be expected to have a corrosion rate of less than about 1 mil/year. Examples of equipment which can be fabricated from the extruded molybdenum alloy are the shaft of an agitator assembly, distribution rings, among many others.

The process of the invention is capable of extruding MoRe alloys, which comprise about 10 to about 50% by wt. rhenium, in air, at a temperature of about 1300° C., into seamless pipes or tubes. While molybdenum alloys containing less than about 10 and greater than 50% rhenium have certain desirable properties, such alloys are believed to have limited utility in the pipe or tube extrusion of the invention.

The pipe or tube, which can be produced by the present invention, typically has an outer diameter of up to at least about 122 mm (about 4.9 inches), a wall thickness of up to at least about 27 mm (about 1.05 inches), and a length of at least about 1310 mm (about 51.6 inches).

The process of the invention for extruding MoRe alloys generally comprises:

fabricating a MoRe billet or blank which includes a pilot hole that extends along the longitudinal axis of the billet, and is comprised of the desired molybdenum-rhenium alloy which typically includes a quantity of carbon that is sufficient to prevent high temperature oxidation, providing a suitable furnace which is capable of heating the MoRe billet to a first temperature of about 1000° to 1300° C. while maintaining the billet within a protective gas atmosphere, providing a means of conveying the heated billet to an electrical induction furnace, providing an electrical induction heater which is capable of heating, or reheating the billet when has cooled from the first temperature, in a manner that is sufficient to cause the billet to be heated to a second temperature of at least about 1300° C., providing a means of conveying the heated billet to an extrusion press, providing an extrusion press which is equipped with a heat-resistant mandrel, and;

extruding the billet.

While any suitable fabrication method may be used, the MoRe billet is typically fabricated by powder metallurgy techniques because such techniques can obtain a molybdenum-rhenium alloy that has a uniform composition. An example of a suitable billet composition comprises about 50 to about 90 wt. % molybdenum, about 10 to about 50 wt. % rhenium, and about 30 to 100 ppm carbon. Without wishing to be bound by any theory or explanation, it is believed that, when present, the carbon component of the alloy functions as a deoxidant. In some cases, about 10 to about 20 wt. % tungsten is included in the alloy for increasing the hardness of the alloy. In order to form the billet, the metal powders and carbon can be mixed, compressed under high pressure to the desired billet shape and dimensions, and then subjected to a high temperature treatment. A suitable heat treatment comprises sintering the compressed billet at a temperature which is below the melting point of the metals. Such a heat treatment typically produces billets which possess nearly theoretical densities, and are suitable for use in pipe or tube formation.

A key physical characteristic of the billet is the provision of an axial pilot hole which extends along the longitudinal axis of the billet. The axial pilot hole enhances the ease with which the billet is extruded into a seamless tube or pipe, and serves to guide the mandrel through the billet thereby increasing the mandrel penetration rate.

The pilot hole may be provided by any suitable techniques such as appropriately molding the billet during its fabrication, drilling a solid billet, among others. Should the dimensions of the exterior portion of the billet require modification, the exterior of the billet can be machined. The dimensions of an acceptable billet are about 194 mm (about 7.64 inches) outside diameter, 94 mm (about 3.70 inches) internal diameter, and 520 mm (about 20.47 inches) in length.

Certain physical characteristics of the billet are illustrated in FIG. 1 which is drawn to scale. Referring now to FIG. 1, 10 refers to the longitudinal axis along which pilot hole 11 is located within billet 12. The end of billet 12 at which the pressing force is applied comprises a so-called dummy block 13 (also discussed below in connection with FIG. 3). The interior circumference of the terminal end 14 of block 13 is machined or rounded in order to accommodate the application of force. The interior circumference of the other terminal end 15 of billet 12 is also machined or rounded to enhance the interaction between the billet and an extrusion die. An example of a suitable extruder is dissussed below in connection with FIG. 3.

Figure 2:
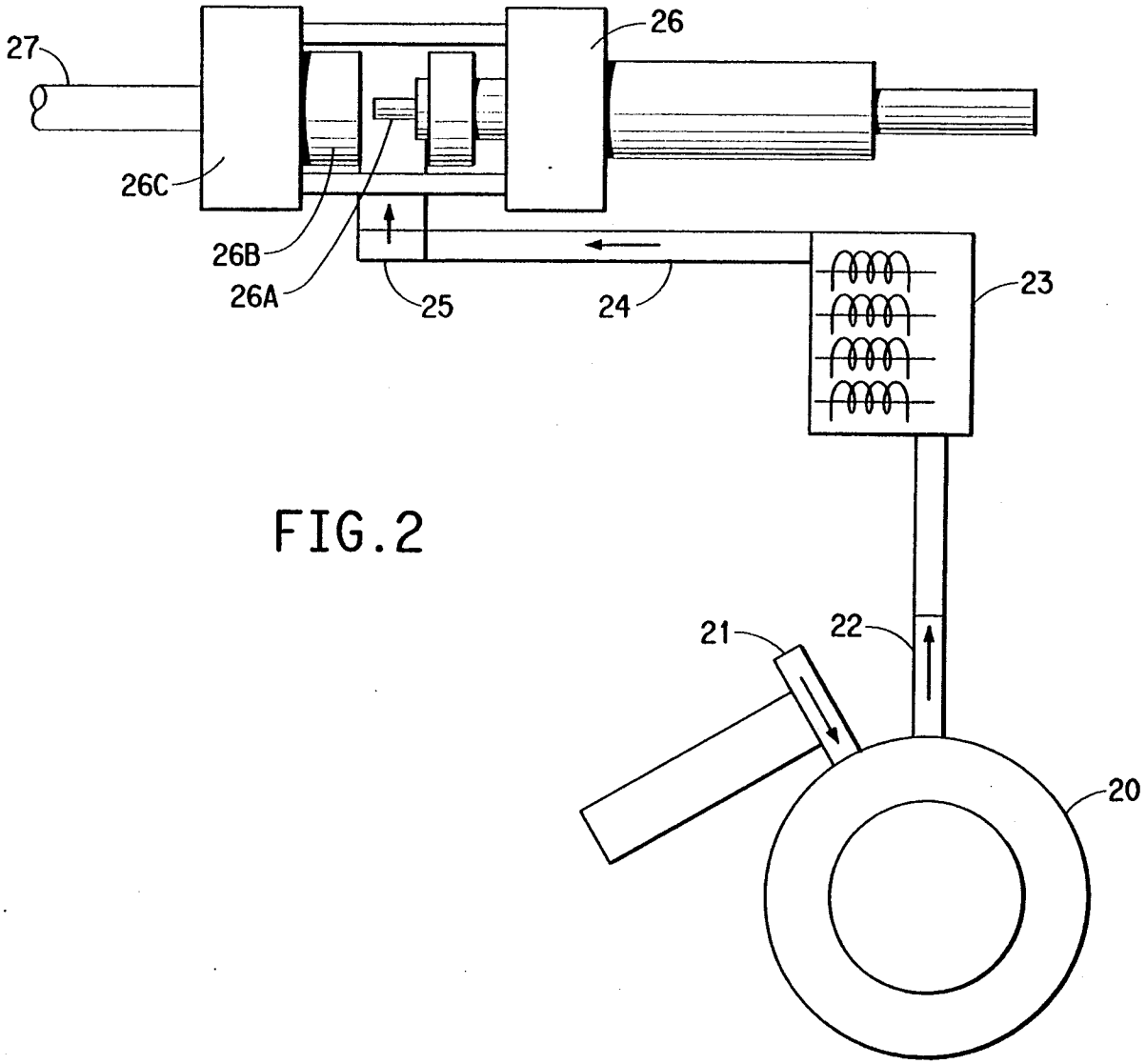
FIG. 2 is a cross-sectional schematic drawing of an apparatus which can be used in connection with extruding MoRe pipes or tubes. In particular.

An appropriately formed and shaped MoRe billet is prepared for extrusion. The basic equipment which is used for extruding the billet can be commercially available stainless steel hot-extrusion equipment which has been modified to accommodate the higher MoRe forming resistance and extrusion temperatures. An example of a series of equipment which is suitable for extruding a MoRe billet is illustrated in FIG. 2. Referring now to FIG. 2, the MoRe billet may be heated initially by any suitable furnace means 20 which does not expose the billet to an oxidizing environment. A suitable heating means 20 comprises a natural gas fired rotary hearth furnace, and a protective internal gas atmosphere, e.g., comprising approximately 15–18% hydrogen, 10–12% carbon monoxide, 2—4% carbon dioxide, the remainder nitrogen. The protective atmosphere can be introduced into the furnace 20 at 21, and supplied by a source which is external to furnace 20. Typically, the furnace will have three heating zones (not shown) which are maintained at a temperature that ranges from about 1190° to about 1220° C. The initial billet heating time is at least about 120 minutes. After reaching the initial billet temperature, e.g., below the desired extrusion temperature or about 1110° C., the billet is transferred from the furnace to an induction heating means. Any suitable means such as a temperature resistant mechanical conveyor 22 can be used for transferring the heated billet to the induction heating means 23. While any suitable heating means could be employed following the initial billet heating step, induction heating is preferred because induction heating permits precise temperature control, thereby enhancing the reliability and consistency of the process. However, operation of an induction heater 23 is relatively expensive in comparison to other heating means. As a result, by employing the rotary hearth furnace 20 for initially heating the billet, and an induction heater 23 for increasing the temperature of the billet, the costs associated with induction heating are reduced. The induction heater 23 increases, or reheats the billet to a second temperature of about 1270° C. to about 1300° C. The heated billet is then transported via conveyor 24 to a location 25 that is adjacent to the extruder at which the heated billet can be coated with a suitable lubricating material. For example, location 25 may comprise a downwardly sloping chute which contains a powdered glass lubricant that costs the heated billet with glass powder as the billet rolls through the chute. The coated billet is loaded into the extruder 26. (An example of a suitable extruder is discussed below in connection with FIG. 3.) The extruder stem 26A approaches the billet which is housed within container 26B. A force is applied by extruder stem 26A which is adequate to cause the billet to exit container 26B, and be shaped by a die which is supported by platen 26C. When a pipe or tube exits the extruder 26, it is cradled within a trough 27 which protects the extruded pipe or tube from excessive cooling rates, wrapping, among other. For best results, the hot extruded MoRe pipe or tube is cooled slowly to avoid cracking the pipe, e.g., cooled at a rate of about 35° C./hr. Any suitable technique can be employed for slowly cooling the pipe or tube such as placing the newly extruded hot pipe upon a bed of a non-conductive material, e.g., vermiculite.

Figure 3:
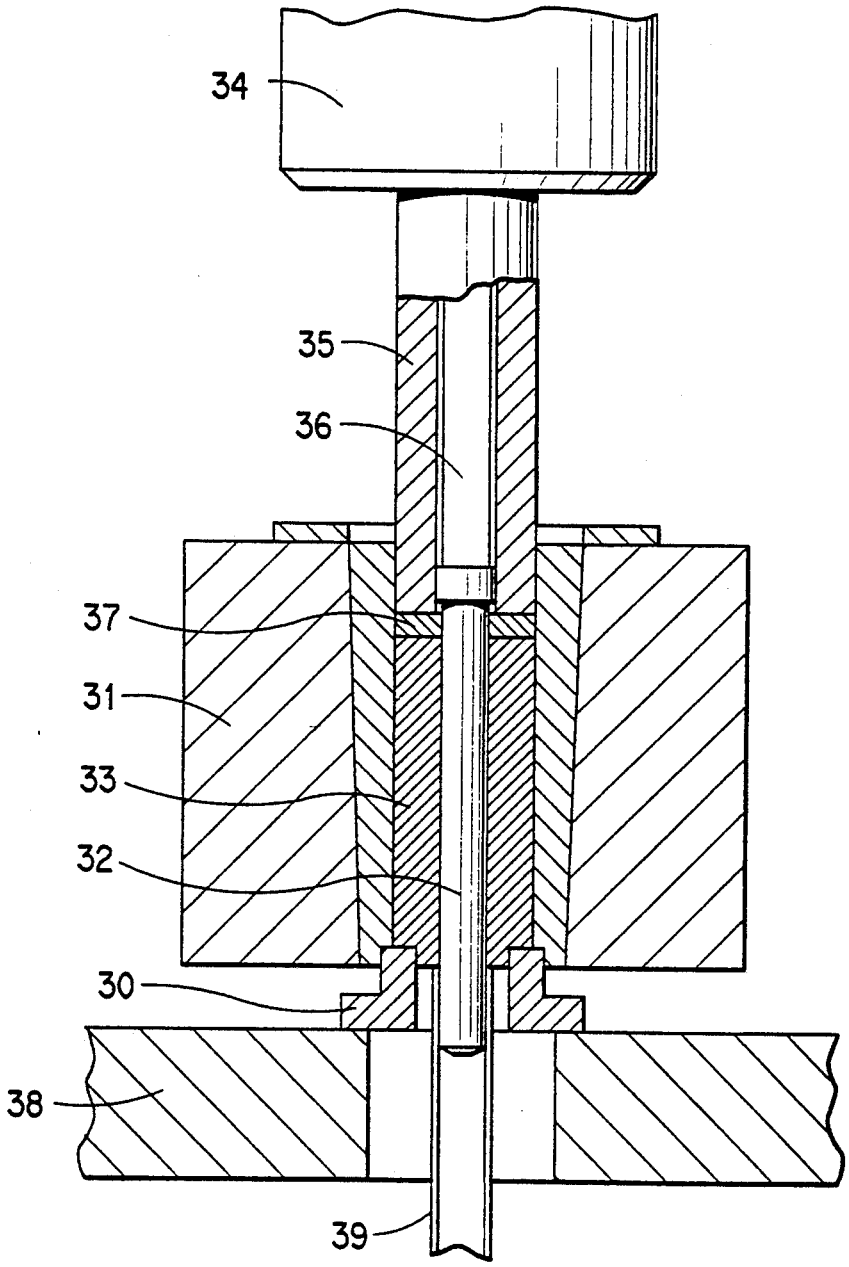
FIG. 3 is a cross-sectional schematic drawing of a billet extruder.

FIG. 3 is a cross-sectional schematic of an extruder which can be used for forming a seamless pipe or tube. Referring now to FIG. 3, die 30 and container 31 are fabricated from or lined with a heat-resistant material. Modifying the diameter of the die can be used to control the dimensions of the extruded product. Further, modifying the diameter of the die can be used to alter the press force, which is applied to the billet, during the extrusion process, e.g., a relatively small die typically increases the press force. For example, a die having a diameter of at least about 120.5 mm (about 4.74 inches) can be employed when extruding a pipe which has an outside diameter of about 118 mm (about 4.65 inches). The container, which can be used for housing the billet during extrusion, may have a diameter that ranges from 200.0 mm (about 7.87 inches) to at least about 300.0 mm, and about 750.0 mm (about 29.53 inches) in length. Similar to the die, by altering the dimensions of the container, the extrusion press force upon the billet can be modified. Mandrel 32, which is also fabricated from a heat-resistant material, is surrounded by container 31, and extrudes billet 33 by translating the force from stem holder 34 to billet 33. For best results, the configuration of billet 33 corresponds to the billet which is illustrated in FIG. 1. The mandrel 32 typically has a diameter of about 79.0 mm (about 3.11 inches). The mandrel 32 is mounted onto stem 35 by mandrel holder 36. A dummy block 37, which is also illustrated in FIG. 1, is located between stem 35 and billet 33. The mandrel 32 and stem 35 are rammed into the billet 33 at a rate of at least about 100 to about 250 mm/second (about 3.94 to about 9.84 inches/second), and applied a pressing force. As the pressing force is applied onto stem 35, the force causes billet 33 to deform and be shaped by die 30. A platen 38, which typically comprises a unitary cast metal body, supports the force being applied to the billet 33, and stabilizes the positioning of die 30, during the extrusion of pipe 39.

Any suitable extrusion press can be used for extruding the heated billet so long as the extrusion press is capable of withstanding the temperature of the heated billet, and exerting a pressure which is adequate to extrude the MoRe alloy billet. The orientation of the billet during extrusion is not critical, e.g., the billet can be extruded either horizontally or downwardly. The pressure required for billet extrusion is a function of the hot forming resistance of the alloy to be extruded, the size of the billet being extruded, and the degree of billet deformation which is required for achieving the dimension of the desired seamless pipe or tube.

One formula for determining the extrusion pressure reads as follows:

$$F=(\ln R)(Ao)(kw)(e \text{ to the mu x K power})$$

wherein F is the required press force in Newtons, R is the ratio of extrusion, which is equal to the cross-sectional area of the billet divided by the cross-sectional area of the extruded pipe, and greater than 1.0, Ao is the cross section of the billet under load expressed in sq. mm., kw is the hot forming resistance of the alloy expressed in Newtons/sq. mm., mu is the friction coefficient of the container, e.g., 0.01, K is a geometry factor equal to 4 L divided by (D−d), wherein L is the length of the billet, D is the diameter of the container, e.g., 200 mm (about 7.87 inches), and d is the diameter of the mandrel. The process parameters of the above formula are monitored, and can be controlled during extrusion in order to improve the extrusion process and improve the characteristics of the resultant pipe or tube. The above formula can also be employed to ascertain how to modify the structural dimensions of an extruder in order to achieve the necessary pressing force. For example, the pressing force can be increased by increasing the diameter of the mandrel, among others.

The hot forming resistance (kw) is a function of temperature. For best results, the extrusion temperature of the MoRe billet is about 1300° C. Extrusion temperatures which are significantly below 1300° C. tend to increase the pressure required for extrusion, whereas an extrusion temperature greater than 1300° C. is costly to maintain and increase the risk of oxygen contamination. The temperature of the billet prior to extrusion and during extrusion can be measured, for example, by a Cyclops 51 Minolta Land Pyrometer.

While particular emphasis has been placed upon the process conditions and apparatus which are employed to extrude a MoRe alloy product, i.e., a pipe or tube, the characteristics of the product can be improved by annealing or heat treating the billet and/or the extruded product. For example, a billet or extruded product can be annealed by being heated to a temperature of about 1,050 to at least about 1,100° C. under a hydrogen-containing atmosphere which is maintained for about 2.5 to at least about 3.0 hours. Although any suitable annealing process can be employed, the annealing process preferably will induce less than about 5% alloy recrystallization.

The following Example is being provided to illustrate the subject matter of the invention not limit the scope of the appended claims. Unless specified otherwise commercially available materials were used when the Example was performed.

EXAMPLE

Two pipe billets were made by mixing molybdenum, rhenium and carbon powders in the proper proportion to obtain a Mo41% Re alloy. The powders were then compressed and sintered to form hollow cylindrical billets which has a nominal outside dimension of about 194 mm (7.64 in.), and an internal diameter of about 94 mm (3.70 in.). The length of each billet was approximately 520 mm (about 20.5 in.), and the weight was about 155 kg (about 342 lbs.). The surface roughness of the outside wall of the billet was about Ra=2.8 mu.

The billets were then heated individually within a natural gas fired rotary-hearth furnace which had three heating zones that were maintained, respectively, at 1200°, 1220° and 1190° C. A protective gas atmosphere surrounded the billets, and had a composition of about 15 to about 18% hydrogen, 10 to 12% carbon monoxide, 2 to 4% carbon dioxide, and the remainder nitrogen. The heating time for the billets in the furnace was approximately 120 minutes. The temperatures of the billets measured immediately after being taken out of the furnace was about 1110° C.

The heated billets were then conveyed for reheating to an induction heater which had a net frequency of about 50 Hz, and a maximum power of approximately 600 KW. Temperature measurement was made via a hole in the induction coil by using a pyrometer.

The reheating temperature for the first billet was about 1270° C. The first billet was then conveyed to an extrusion press, and placed within an extrusion press container which had a nominal diameter of about 200 mm (about 7.9 in.), and a length of approximately 750 mm (about 29.5 in.). The press used a die which had a diameter of about 120.5 mm (4.74 in.), and a mandrel of about 79.0 mm (3.11 in.) in diameter. The pressing disc or "dummy-block" behind the billet had a diameter of about 198.5 mm (7.81 in.). All parts of the processing apparatus which came into contact with the heated billet were fabricated from hot working steel per AISI H11 or ASTM A681-76. Powdered glass which had a melting point less than the temperature of the heated billet was introduced prior to placing the billet within the container in order to provide lubrication during the extrusion process.

Extrusion of the first billet failed because an insufficient press force was applied to the billet. After the first trial, the hot forming resistance of the Mo41% Re alloy was calculated as being 700 Newtons/sq. mm. (about 102,000 psi). Such a forming resistance was achieved by using an extrusion apparatus which had a mandrel with a diameter of about 69.0 mm (2.71 in.), and forming a pipe which has a wall thickness from about 20 to 25 mm (0.79 to 0.98 in.).

A second extrusion trial was performed using the second billet, and the extrusion procedure discussed above in connection with the first trial with the exception that the reheat temperature was increased to about 1330° C. The ram speed of the mandrel was about 180 mm/second (about 7.1 inches/second). A press force of about 2,725 metric tons (6.0 million pounds), was applied to the billet which successfully produced a seamless pipe.

The first billet was then remachined to dimensions which measured about 184.7 mm (about 7.3 in.) outer diameter, 94.1 mm (about 3.7 in.) internal diameter, and about 520.0 mm (about 20.5 in.) in length, and re-extruded using the extrusion procedure discussed above with the exception that the reheat temperature was increased to about 1300° C. A press force of about 3,036 metric tons (6.69 million lbs), was applied to the billet which successfully produced a pipe. The hot forming resistance of the remachined billet was calculated as being about 690 to 700 Newtons/sq.mm (about 101,500 psi).

After extrusion, both pipes were placed into a bed of vermiculite to ensure a relatively slow cooling rate of about 35° C./hour which avoids cracking the pipe. Twenty four hours later the cooled pipes were removed from the vermiculite and cleaned by being pickled in $HF/H_2SO_4$ acid solution, and then water rinsed. The finished pipe dimensions were measured. The first pipe produced (from billet no. 2) had an average outside diameter of about 121.6 mm (about 4.79 inches), an average wall thickness of about 26.7 mm (about 1.05 inches), a length of about 1310 mm (about 51.6 in.), and a weight of 128 kg (282 lb.). About 17.4% by weight of the original billet was lost as a result of processing and machining. The second pipe produced, i.e., from remachined billet no. 1, had an average outside diameter of about 120.5 mm (4.74 inches), an average wall thickness of about 26.44 mm (about 1.04 inches), a length of about 1190 mm (about 46.85 inches), and a weight of about 114 kg (251 lb).

While a few embodiments of the invention have been described above in detail, one of ordinary skill in this art would recognize that other embodiments and variations are encompassed by the appended claims.

The following is claimed:

1. A process for extruding MoRe alloys comprising:
fabricating a MoRe billet which includes a pilot hole that extends along the longitudinal axis of the billet,
heating the MoRe billet to a first temperature of about 1000° to 1300° C. while maintaining the billet within a protective gas atmosphere,
conveying the heated billet to an electrical induction furnace,
heating the heated billet to a second temperature of at least about 1300° C.,
conveying the heated billet to an extrusion press, lubricating the billet, and extruding the billet.

2. The process of claim 1, wherein said alloy includes a quantity of carbon that is sufficient to prevent oxidation.

3. A process for extruding MoRe alloys comprising:
fabricating a MoRe billet which is comprised of about 10 to about 50% rhenium, and a quantity of carbon that is sufficient to prevent high temperature oxidation,
heating the MoRe billet to a first temperature of about 1000° to 1300° C.,
conveying the heated billet to an electrical induction furnace,
heating the billet to a second temperature that is at least about 1300° C., and;
extruding the billet.

4. The process of claim 3, further comprising lubricating the billet prior to extrusion.

5. The process of claim 3, wherein said MoRe billet is heated to the first temperature in a protective atmosphere.

6. The process of claim 1 or 4, wherein said atmosphere comprises at least one member from the group consisting of $N_2$, CO, $H_2$, and $CO_2$.

7. The process of claim 1 or 3, wherein said billet is extruded into a pipe or tube.

8. The process of claim 6, wherein at least one of said billet, pipe, or tube is annealed.

9. The process of claim 8, wherein said annealing induces less than about 5% alloy recrystallization.

10. The process of claim 1 or 3, wherein said extrusion press employs a billet ramming speed of about 150 to about 200 mm/sec.

* * * * *